US008272080B2

(12) United States Patent
Stimpson

(10) Patent No.: US 8,272,080 B2
(45) Date of Patent: Sep. 25, 2012

(54) PUMPED SHOWER DRAINING DEVICE

(75) Inventor: Robert William Stimpson, Douglas (GB)

(73) Assignee: DLP Limited, British Isles (IM)

( * ) Notice: Subject to any disclaimer, the term of this patent is extended or adjusted under 35 U.S.C. 154(b) by 324 days.

(21) Appl. No.: 12/637,764

(22) Filed: Dec. 15, 2009

(65) Prior Publication Data

US 2010/0154113 A1 Jun. 24, 2010

(30) Foreign Application Priority Data

Dec. 24, 2008 (GB) ..... 0823513.7

(51) Int. Cl.
*A47K 3/00* (2006.01)

(52) U.S. Cl. ..... 4/613

(58) Field of Classification Search ..... 4/613, 665; 417/223, 319; 192/58.61, 58.612
See application file for complete search history.

(56) References Cited

U.S. PATENT DOCUMENTS

| | | | | |
|---|---|---|---|---|
| 4,984,314 | A * | 1/1991 | Weigert | 4/663 |
| 5,206,963 | A * | 5/1993 | Wiens | 4/603 |
| 5,233,706 | A * | 8/1993 | Maehr | 4/596 |
| 5,265,287 | A * | 11/1993 | Henkin et al. | 4/605 |
| 5,309,582 | A * | 5/1994 | Henkin et al. | 4/603 |
| 5,345,625 | A * | 9/1994 | Diemand | 4/665 |
| 5,544,369 | A * | 8/1996 | Roberts | 4/599 |
| 5,603,344 | A * | 2/1997 | Hall, Jr. | 137/2 |
| 5,953,770 | A * | 9/1999 | Kitamura | 4/601 |
| 5,996,140 | A * | 12/1999 | Kitamura | 4/604 |
| 7,937,785 | B2 * | 5/2011 | Stimpson et al. | 4/665 |
| 7,975,328 | B2 * | 7/2011 | Lock et al. | 4/613 |
| 7,984,684 | B2 * | 7/2011 | Hinderks | 114/274 |
| 2009/0320204 | A1 * | 12/2009 | Wiseman et al. | 4/613 |
| 2010/0045471 | A1 * | 2/2010 | Meyers | 340/605 |
| 2010/0154113 | A1 * | 6/2010 | Stimpson | 4/613 |

FOREIGN PATENT DOCUMENTS

| | | | |
|---|---|---|---|
| DE | 19602098 | A1 | 7/1997 |
| EP | WO2006/119951 | A1 | 11/2006 |
| EP | 1959144 | A2 | 8/2008 |
| FR | 2899609 | A1 | 10/2007 |
| GB | 2288413 | A | 10/1995 |
| GB | 2310374 | A | 8/1997 |
| GB | 2355653 | A | 5/2001 |
| GB | 2443422 | A | 5/2008 |

OTHER PUBLICATIONS

European Search Report for EP09275123 completed on Mar. 30, 2010.

* cited by examiner

*Primary Examiner* — Lori Baker
(74) *Attorney, Agent, or Firm* — Pyprus Pte Ltd

(57) ABSTRACT

A pumped shower draining device for shower apparatus, the device comprising a housing having a waste water inlet and a waste water outlet, a pump element provided within or adjacent to the housing which pumps waste water from the waste water inlet to the waste water outlet, a first pump-driving device drivably engaged with the pump element, a second pump-driving device drivably engaged with the pump element, and a controller to control the first and/or second pump-driving devices. The first pump-driving device is hydraulically operable by shower water supplied to a shower head. The second pump-driving device is electrically operable, and the controller controls at least one of the first pump-driving device and second pump-driving device to supplement and/or to be substituted for the other. Shower apparatus having the pumped shower draining device is also provided.

15 Claims, 1 Drawing Sheet

PUMPED SHOWER DRAINING DEVICE

The present invention relates to a pumped shower draining device, and also to shower apparatus including such a pumped shower draining device.

BACKGROUND OF THE INVENTION

Shower drain pump systems typically include an electric shower drain pump connected to sensors for detecting water flow through a shower water heater or shower head. When the sensors detect flowing water, the pump is switched on.

The problem with this arrangement is that electricity is consumed all the while the pump is operational.

The present invention therefore seeks to provide a solution which reduces electricity consumption.

SUMMARY OF THE INVENTION

According to a first aspect of the invention, there is provided a pumped shower draining device for shower apparatus, the device comprising a housing having a waste water inlet and a waste water outlet, a pump element provided within or adjacent to the housing which pumps waste water from the waste water inlet to the waste water outlet, a first pump-driving device drivably engaged with the pump element, a second pump-driving device drivably engaged with the pump element, and a controller to control the first and/or second pump-driving devices, the first pump-driving device being hydraulically operable by shower water supplied to a shower head, the second pump-driving device being electrically operable, and the controller controlling at least one of the first pump-driving device and second pump-driving device to supplement and/or be substituted for the other.

According to a second aspect of the invention, there is provided Shower apparatus comprising: a shower head; a shower-water supply liquidly communicable with the shower head; a drain unit; and a pumped shower draining device including a housing having a waste water inlet and a waste water outlet, a pump element provided within or adjacent to the housing which pumps waste water from the waste water inlet to the waste water outlet, a first pump-driving device drivably engaged with the pump element, a second pump-driving device drivably engaged with the pump element, and a controller to control the first and/or second pump-driving devices, the first pump-driving device being hydraulically operable by shower water supplied to a shower head, the second pump-driving device being electrically operable, and the controller controlling at least one of the first pump-driving device and second pump-driving device to supplement and/or be substituted for the other; wherein, the first pump-driving device is provided on a flow path upstream of the shower head so as to be operable by the shower water of the shower-water supply.

The invention will now be more particularly described, by way of example only, with reference to the accompanying drawings.

DESCRIPTION OF THE PREFERRED EMBODIMENTS

Figure 1:
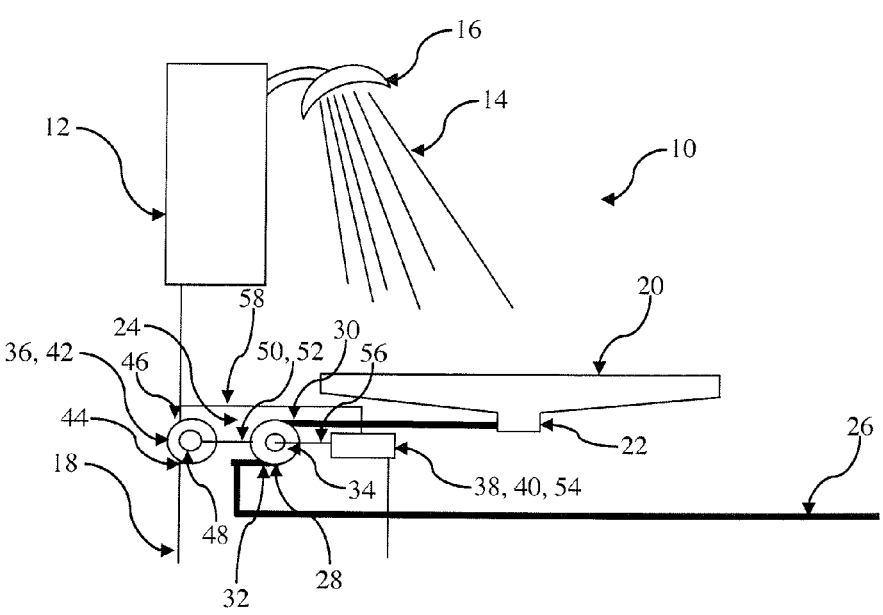
FIG. 1 is a diagrammatic side view of shower apparatus having a first embodiment of a pumped shower draining device, in accordance with the first aspect of the invention.

Referring first to FIG. 1 of the drawings, there is shown shower apparatus 10 which comprises a shower water heater 12 supplying shower water 14 to a shower head 16, a shower-water supply 18 to the shower water heater 12, a showering surface 20, such as a shower tray, below the shower head 16, a drain unit 22 in the showering surface 20, and a first embodiment of a pumped shower draining device 24 for pumping water from the drain unit 22 and discharging to a drain 26.

The shower head 16 may be fixed or removable, and the shower-water supply 18 may be a gravity feed from a header tank or fed from the mains either directly or via, for example, a boiler such as a combination boiler. In the latter case, the shower-water supply 18 is at or substantially at mains pressure.

The pumped shower draining device 24 includes a housing 28 having a waste water inlet 30 for receiving waste shower water runoff from the showering surface 20, and a waste water outlet 32 connected to the drain 26. The housing 28 may be part of the drain unit 22 or may be separate and thus liquidly connected to an outlet of the drain unit 22.

The pumped shower draining device 24 also includes a pump element 34 within or adjacent to the housing 28 for pumping waste water from the waste water inlet 30 to the waste water outlet 32, a primary pump-driving device 36 for primarily driving the pump element 34, a secondary pump-driving device 38 for supplementarily driving the pump element 34, and a controller 40 for controlling the secondary pump-driving device 38.

The pump element 34 may be, for example, a diaphragm pump element which is mounted for reciprocation within the housing 28, or an impeller mounted for rotation within the housing.

The primary pump-driving device 36 includes a casing 42 having a shower-water supply inlet 44 and a shower-water supply outlet 46. The casing 42 is provided on a flow path of the shower-water supply 18, typically so that the shower-water supply outlet 46 is upstream of the shower-water heater 12. However, as long as the shower-water supply inlet 44 of the casing 42 is receiving shower water 14 from the shower-water supply 18 and the shower-water supply outlet 46 is supplying the shower water 14 to the shower head 16, it is feasible that the casing 42 can be incorporated within the shower-water heater 12 or may even be at or adjacent to the shower head 16 itself.

The primary pump-driving device 36 also includes an impellor 48 which is rotatably mounted within the casing 42, and an output shaft 50 of the impellor 48 is connected via a first drive mechanism 52 to the pump element 34 within the housing 28.

The secondary pump-driving device 38 includes a mains powered electric motor 54 connected via a second drive mechanism 56 to the pump element 34 within the housing 28.

The controller 40 includes electronic circuitry and at least one sensor 58 for monitoring a flow rate of the shower-water supply 18, either upstream of the shower-water heater 12 or the shower head 16, or at the shower head 16. Alternatively or additionally, the or a further sensor may monitor movement of the impellor 48 or first drive mechanism 52 of the primary pump-driving device 36. The electronic circuitry is programmed to activate the secondary pump-driving device 38 when it determines that the shower-water supply flow rate drops to or below a predetermined amount.

The primary pump-driving device 36 is thus solely hydromechanical, resulting in the pump element 34 being operated by a hydraulically driven mechanical mechanism through shower water supplied to the shower head 16. The secondary pump-driving device 38 supplements, supplants or is substitutable for the primary pump-driving device 36, cutting in once flow to the shower head 16 decreases or stops.

Preferably, once the controller 40 determines that shower water flow to the shower head 16 has entirely halted, a timer in the controller 40 allows the secondary pump-driving device 38 to run on for a predetermined time to clear any final waste shower water runoff from the showering surface 20 before it is deactivated. The timer is preferably settable depending on requirements, such as flow rate of the shower-water supply 18.

In this first embodiment, the primary pump-driving device 36 and the secondary pump-driving device 38 are separate and may be independent of each other. However, the drive mechanisms mentioned above may be common.

Figure 2:
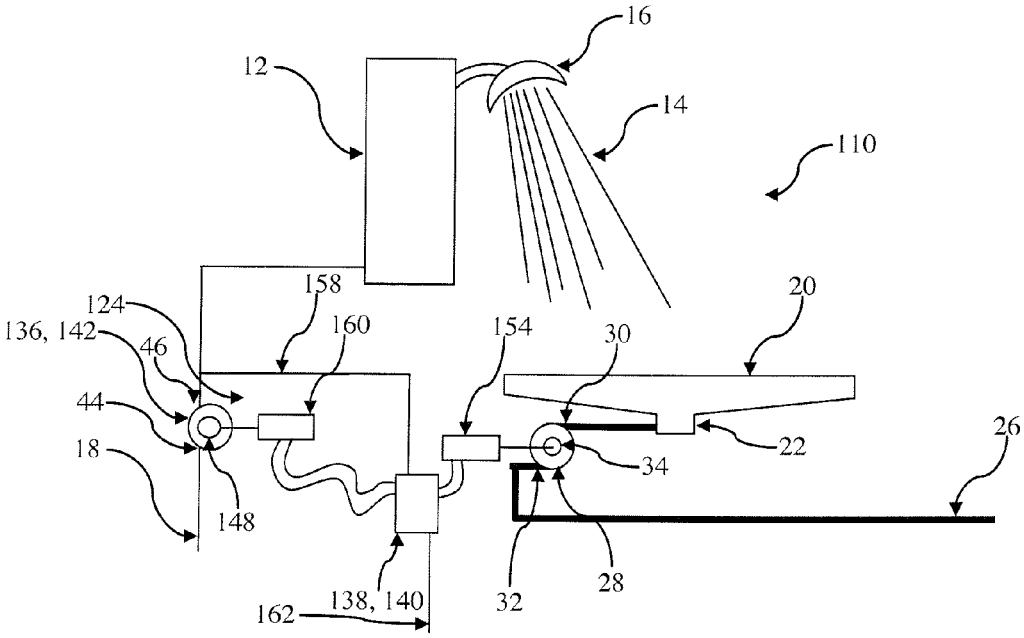
FIG. 2 is a diagrammatic side view of shower apparatus having a second embodiment of a pumped shower draining device, in accordance with the first aspect of the invention.

Referring to FIG. 2 of the drawings, there is shown shower apparatus 110 comprising a second embodiment of a pumped shower draining device 124. In all other respects, the shower apparatus 110 is the same as that described with respect to the first embodiment, and therefore like references are used for like parts and further detailed description is omitted.

In this embodiment, the primary pump-driving device 136 utilises the casing 142 on the flow path of the shower-water supply 18 and the impellor 148 as above. However, an output of the impellor 148 is connected to a generator 160 for supplying electricity to a common electric motor 154. The pump element 34 is thus drivable by the common electric motor 154 once shower water 14 flows through the casing 142 to the shower head 16.

Similarly to the first embodiment, the secondary pump-driving device 138 includes the common electric motor 154 and a mains electricity supply 162 for energising the common electric motor 154.

The controller 140, as above, includes electronic circuitry and at least one sensor 158 for monitoring a flow rate of the shower-water supply 18. Alternatively or additionally, the or a further sensor may monitor movement of the impellor 148 or drive mechanism of the primary pump-driving device 136. The electronic circuitry is programmed to activate the secondary pump-driving device 138 when it determines that the shower-water supply 18 flow rate drops to or below a predetermined amount.

The primary pump-driving device 136 is thus hydroelectric-mechanical, resulting in the pump element 34 being operated by a hydraulically driven electromechanical mechanism through shower water 14 supplied to the shower head 16. The secondary pump-driving device 138 supplements or supplants the primary pump-driving device 136, cutting in once flow to the shower head 16 decreases or stops.

Once the controller 140 determines that shower water 14 flow to the shower head 16 has entirely halted, the, preferably settable, timer in the controller 140 allows the secondary pump-driving device 138 to run on for a predetermined time to clear any final waste shower water 14 runoff from the showering surface 20 before it is deactivated.

In this second embodiment, the primary pump-driving device 136 and the secondary pump-driving device 138 share common parts, and may be considered to be in series with each other as shown in FIG. 2.

It is also feasible to modify the embodiments above. For example, the primary pump-driving device of the first embodiment may be or include hydroelectric means, such as a hydroelectric generator, for supplying electricity to an electric motor for driving the pump element. The hydroelectric means may also supply electricity to the controller for monitoring a flow rate of the shower-water supply. In this case, the sensor may be dispensed with since, once the controller stops receiving a sufficient level of current from the hydroelectric means, the secondary pump-driving device is activated.

A combination of the two embodiments can thus be envisaged, using a hydroelectric generator to provide both a control and/or sensor signal, as well as power to operate the controller and primary pump-driving device.

It is also feasible that the secondary pump-driving device can be primarily operated in favour of the primary pump-driving device, with the primary pump-driving device thus functioning as a back-up or supplementary device. In this case, the mains powered electric motor of the secondary pump-driving device is primarily utilised to pump water from the shower, but the primary pump-driving device is utilised to reduce load on the pump element when running. This provides a simplified arrangement which reduces power consumption over at least part of the pumping cycle. In this case also, the two pump-driving devices are preferably operated at least simultaneously, even when reasonable flow from the shower-water supply is in evidence, rather than one pump-driving device supplanting the other once the flow-rate drops.

It is thus possible to provide a pumped shower draining device having a hydraulically-operable first pump-driving device which operates the majority of the time the shower is in use, and a mains-supplied second pump-driving device which supplements or takes over from the first pump-driving device when the in use shower is halted or has its flow reduced. Mains electricity usage is thus significantly reduced, presenting cost savings to the user. The first pump-driving device is simple to fit, either during installation of the shower apparatus or as a retro-fit, and for example can use speed- or push-fit couplings at the casing for in-line connection with the shower-water supply. It is also possible to provide a shower apparatus as an installation or as a kit of parts which includes the pumped shower draining device.

The embodiments described above are provided by way of examples only, and various other modifications will be apparent to persons skilled in the art without departing from the scope of the invention as defined by the appended claims.

What is claimed is:

1. A pumped shower draining device for shower apparatus, the device comprising a housing having a waste water inlet and a waste water outlet, a pump element provided within or adjacent to the housing which pumps waste water from the waste water inlet to the waste water outlet, a first pump-driving device drivably engaged with the pump element, a second pump-driving device drivably engaged with the pump element, and a controller to control the first and/or second pump-driving devices, the first pump-driving device being hydraulically operable by shower water supplied to a shower head, the second pump-driving device being electrically operable, and the controller controlling at least one of the first pump-driving device and second pump-driving device to supplement and/or be substituted for the other.

2. A pumped shower draining device as claimed in claim 1, wherein the first pump-driving device primarily drives the pump element, and the second pump-driving device supplementarily drives the pump element.

3. A pumped shower draining device as claimed in claim 2, wherein the controller activates the second pump-driving device when a flow rate of the shower water drops to a predetermined amount.

4. A pumped shower draining device as claimed in claim 1, wherein the first pump-driving device includes an impellor drivable by the shower-water supply.

5. A pumped shower draining device as claimed in claim 1, wherein the first pump-driving device is solely hydromechanical.

6. A pumped shower draining device as claimed in claim 5, wherein the first pump-driving device and the second pump-driving device are separate of each other.

7. A pumped shower draining device as claimed in claim 1, wherein the first pump-driving device includes a hydroelectric generator element.

8. A pumped shower draining device as claimed in claim 7, wherein the first pump-driving device and the second pump-driving device have a common electric motor.

9. A pumped shower draining device as claimed in claim 1, wherein the controller includes at least one flow sensor to sense the now rate of the shower water.

10. A pumped shower draining device as claimed in claim 1, wherein the controller receives a signal from the first pump-driving device to activate the second pump-driving device.

11. Shower apparatus comprising: a shower head; a shower-water supply liquidly communicable with the shower head; a drain unit; and a pumped shower draining device including a housing having a waste water inlet and a waste water outlet, a pump element provided within or adjacent to the housing which pumps waste water from the waste water inlet to the waste water outlet, a first pump-driving device drivably engaged with the pump element, a second pump-driving device drivably engaged with the pump element, and a controller to control the first and/or second pump-driving devices, the first pump-driving device being hydraulically operable by shower water supplied to a shower head, the second pump-driving device being electrically operable, and the controller controlling at least one of the first pump-driving device and second pump-driving device to supplement and/or be substituted for the other; wherein, the first pump-driving device is provided on a flow path upstream of the shower head so as to be operable by the shower water of the shower-water supply.

12. Shower apparatus as claimed in claim 11, further comprising a shower water heater, the first pump-driving device being provided upstream thereof.

13. Shower apparatus as claimed in claim 11, wherein the controller monitors a flow rate of the shower water to the shower head, and activates the second pump-driving device when a flow rate of the shower water drops to a predetermined amount.

14. Shower apparatus as claimed in claim 13, wherein the controller monitors a flow rate of waste shower water in, to or from the drain unit, and activates the second pump-driving device when a flow rate of the waste shower water increases to a predetermined amount.

15. Shower apparatus as claimed in claim 11, wherein the controller controls the second pump-driving device to operate simultaneously with the first pump-driving device, such that the first pump-driving device reduces a load on the second pump-driving device.

* * * * *

UNITED STATES PATENT AND TRADEMARK OFFICE

CERTIFICATE OF CORRECTION

PATENT NO. : 8,272,080 B2
APPLICATION NO. : 12/637764
DATED : September 25, 2012
INVENTOR(S) : Robert William Stimpson It is certified that error appears in the above-identified patent and that said Letters Patent is hereby corrected as shown below:

Column 5, line 16, delete “now” and replace with “flow”

Signed and Sealed this
Fourth Day of December, 2012

David J. Kappos

David J. Kappos
*Director of the United States Patent and Trademark Office*